US011000888B2

(12) United States Patent
Seidel et al.

(10) Patent No.: US 11,000,888 B2
(45) Date of Patent: May 11, 2021

(54) METHOD FOR PRODUCING A METAL STRIP IN A CAST-ROLLING INSTALLATION

(71) Applicant: SMS GROUP GMBH, Düsseldorf (DE)

(72) Inventors: Jürgen Seidel, Kreuztal (DE); Christoph Klein, Kreuztal (DE); Matthias Peters, Kreuztal (DE); Cosimo Andreas Cecere, Langenfeld (DE)

(73) Assignee: SMS GROUP GMBH, Düsseldorf (DE)

( * ) Notice: Subject to any disclaimer, the term of this patent is extended or adjusted under 35 U.S.C. 154(b) by 0 days.

(21) Appl. No.: 16/346,430

(22) PCT Filed: Jan. 18, 2017

(86) PCT No.: PCT/EP2017/050950
§ 371 (c)(1),
(2) Date: Apr. 30, 2019

(87) PCT Pub. No.: WO2018/086762
PCT Pub. Date: May 17, 2018

(65) Prior Publication Data

US 2020/0061685 A1 Feb. 27, 2020

(30) Foreign Application Priority Data

Nov. 10, 2016 (DE) ..... 10 2016 222 122.1
Dec. 23, 2016 (DE) ..... 10 2016 015 414.4

(51) Int. Cl.
*B21B 1/22* (2006.01)
*C21D 9/60* (2006.01)

(52) U.S. Cl.
CPC ..... *B21B 1/22* (2013.01); *C21D 9/60* (2013.01); *B21B 2001/225* (2013.01)

(58) Field of Classification Search
CPC ..... B21B 1/22; C21D 9/60
See application file for complete search history.

(56) References Cited

U.S. PATENT DOCUMENTS 5,634,257 A 6/1997 Kajiwara
6,062,055 A 5/2000 Bobig
(Continued)

FOREIGN PATENT DOCUMENTS

DE 19613718 C1 10/1997
DE 19518144 C2 12/1999
(Continued)

*Primary Examiner* — Scott R Kastler
(74) *Attorney, Agent, or Firm* — Lucas & Mercanti, LLP; Klaus P. Stoffel

(57) ABSTRACT

A method for producing a metal strip in a cast-rolling installation, the cast-rolling installation includes the following: a casting machine, a first furnace, a first shear, a roughing train, a second furnace, a second shear, a finishing train, a cooling section, a reeling system, and a third shear. In order to allow a flexible reaction to different operating conditions, at least one of the following operating modes is selected in order to produce the strip: a) a continuous rolling, in which the casting machine, the roughing train, and the finishing train are operatively connected together; b) a continuous rolling in the roughing train and a single-strip rolling in the finishing train; c) a single-strip rolling in the roughing train and a single-strip rolling in the finishing train; and d) a semi-continuous rolling in the roughing train and/or a semi-continuous rolling in the finishing train.

15 Claims, 1 Drawing Sheet

(56) References Cited

U.S. PATENT DOCUMENTS

| | | | | |
|---|---|---|---|---|
| 6,092,586 | A | 7/2000 | Schoenbeck | |
| 8,137,485 | B2 | 3/2012 | Seidel | |
| 8,365,806 | B2 | 2/2013 | Rosenthal | |
| 2010/0212856 | A1* | 8/2010 | Rosenthal | B21B 1/46 164/493 |
| 2011/0272116 | A1 | 11/2011 | Benedetti | |
| 2012/0175076 | A1* | 7/2012 | Seidel | B21B 1/463 164/424 |
| 2016/0031808 | A1 | 2/2016 | Venkateswaralu | |
| 2016/0033949 | A1 | 2/2016 | Noda | |

FOREIGN PATENT DOCUMENTS

| | | | |
|---|---|---|---|
| EP | 0889762 | B1 | 10/1999 |
| EP | 1125658 | B1 | 8/2001 |
| EP | 0870553 | B1 | 5/2003 |
| EP | 1960131 | B1 | 8/2008 |
| EP | 2428288 | B1 | 4/2013 |
| EP | 2569104 | B1 | 8/2015 |
| WO | 0010741 | A1 | 3/2000 |
| WO | 2007073841 | A1 | 7/2007 |
| WO | 2009012963 | A1 | 1/2009 |
| WO | 2014050127 | A1 | 4/2014 |
| WO | 2016195172 | A1 | 12/2016 |

* cited by examiner

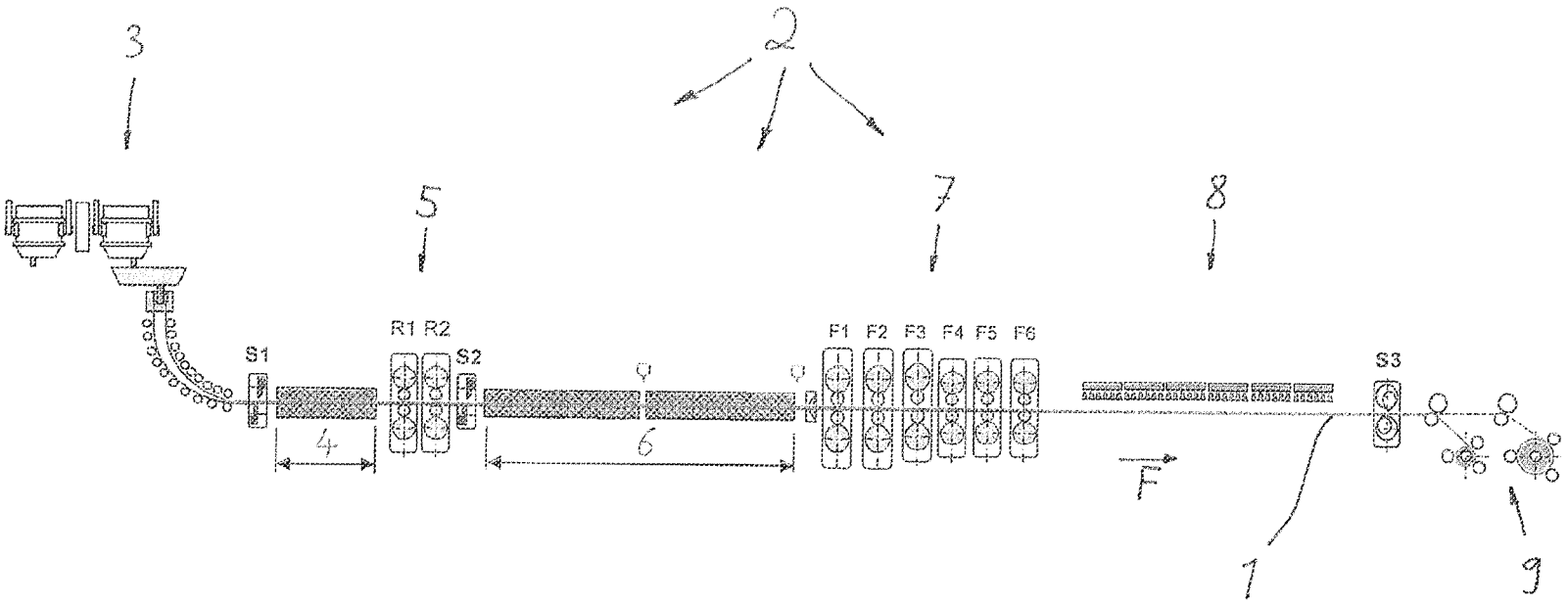
3
S1
4
R1 R2
5
S2
6
2
F1
F2
F3
F4
F5
F6
7
8
F
S3
1
9

METHOD FOR PRODUCING A METAL STRIP IN A CAST-ROLLING INSTALLATION

CROSS-REFERENCE TO RELATED APPLICATIONS

The present application is a 371 of International application PCT/EP2017/050950, filed Jan. 18, 2017, which claims priority of DE 10 2016 222 122.1, filed Nov. 10, 2016, and DE 10 2016 015 414.4, filed Dec. 23, 2016, the priority of these applications is hereby claimed and these applications are incorporated herein by reference.

BACKGROUND OF THE INVENTION

The invention relates to a method for producing a metallic strip in a cast-rolling installation, wherein the cast-rolling installation comprises:

- a casting machine for casting a slab;
- a first furnace and/or a first rolling table damping section, either or both following in the conveying direction of the metallic strip of the roughing train;
- a first shear which is disposed between the casting machine and the first furnace and/or the first rolling table damping section;
- a roughing train having a number of roll stands;
- a second furnace and/or a second rolling table damping section, either or both following in the conveying direction of the metallic strip of the roughing train;
- a second shear which is disposed between the roughing train and the second furnace and/or the second rolling table damping section;
- a finishing train having a number of roll stands;
- a cooling section;
- at least two reels or one reversing reel; and
- a third shear which is disposed between the cooling section and the reeling installation.

The requirements set for the flexible operation of thin-slab cast-rolling installations (CSP installations) are ever-increasing. It is pursued here in that various operating conditions are capable of being set. For example, adapting to the rolled finished strip thickness or to the casting speed is also desirable for reasons of quality and energy consumption.

Thin-slab cast-rolling installations for rolling single strips or for continuous rolling are already well known in the prior art. Reference is made, for example to DE 195 18 144 C2, to DE 196 13 718 C1, to EP 0 870 553 B1, to WO 2007/073841 A1, to WO 2009/012963 A1, and to EP 2 569 104 B1. Further solutions, some of which also involve different operating modes, are known from US 2011/272116 A1 and WO 00/10741 A1.

However, the previously known solutions do in some instances have disadvantages in terms of the aspect of flexibility.

SUMMARY OF THE INVENTION

The invention is therefore based on the object of refining a method of the type mentioned above such that an increased degree in terms of flexibility is possible; it is intended herein that a flexible response to various operating conditions is in particular to be possible. The proposed installation concept and the operating mode are thus to be distinguished by a high degree of flexibility.

The achievement of said object by the invention is characterized in that one of the following operating modes is chosen for the production of the strip:

a) continuous rolling, in which the casting machine, the roughing train, and the finishing train are operatively connected to one another, and the rolling of the material is performed by way of the casting machine mass flow, wherein the finished strips, by means of the third shear, are separated at the reeling installation;

b) continuous rolling in the roughing train, in which the casting machine and the roughing train are operatively connected to one another, and the rolling of the material is performed by way of the casting machine mass flow, and single-strip rolling (batch operation) in the finishing train, wherein the rough strips rolled in the roughing train, by means of the second shear, are separated for the single-strip rolling in the finishing train;

c) single-strip rolling (batch operation) in the roughing train and single-strip rolling (batch operation) in the finishing train, wherein the slabs made in the casting machine, by means of the first shear, are separated for the single-strip rolling in the roughing train and in the finishing train;

d) semi-continuous rolling in the roughing train and/or semi-continuous rolling in the finishing train, wherein the slabs made in the casting machine, by means of the first shear, are separated for the semi-continuous rolling in the roughing train and/or wherein the rough strips rolled in the roughing train, by means of the second shear, are separated for the semi-continuous rolling in the finishing train, wherein the finished strips, by means of the third shear, are separated at the reeling installation, wherein the rolling in the finishing train takes place with the number of roll stands according to the correlation:

$$2.316 \times h_B \times v_B \times e^{(-0.167 \times n)} \geq 480 \text{ m/min mm}$$

where:

n: number of stands in the finishing train $h_B$: thickness of the slab in mm $v_B$: slab speed in m/min.

At least one slab herein is preferably placed in the first furnace and/or in the first rolling table damping section. At least one slab or one rough strip is preferably also placed in the second furnace and/or in the second rolling table damping section.

The above-mentioned operating modes a), b), c), and/or d) herein can be chosen as a function of the final thickness of the strip. It is also possible for the operating modes a), b), c), and/or d), to be chosen as a function of the start-up process of the cast-rolling installation. It is furthermore possible for the operating modes a), b), c), and/or d), to be chosen as a function of a roll change taking place in the roughing train and/or in the finishing train.

One of the operating modes mentioned is first chosen, and the production is then carried out using said mode; accordingly, only one of the mentioned possibilities a), b), c), or d) is implemented at any one time. However, a change between the various operating modes mentioned can also be performed in a temporally successive manner.

The mean slab temperature at the outlet of the first furnace is preferably at least 1000° C., particularly preferably at least 1100° C.

The mean rough strip temperature at the outlet of the second furnace is preferably at least 1100° C., particular preferably at least 1150° C.

One refinement provides that the forming ratio of the strip in the finishing train is:

$$\varepsilon = (h_V - h_F) h_V \times 100 \geq 96\%$$

$h_V$ being the rough strip thickness, and $h_F$ being the finished strip thickness. It is preferably provided especially in this case that the mean rough strip temperature at the outlet of the second furnace is at least 1150° C., wherein the product from the thickness of the strip ($h_B$) and the speed of the strip ($v_B$) is at least 350 mm m/min, preferably at least 500 mm m/min.

It is preferably provided that no inductive heating of the slab or/and the rough strip is performed in the procedure described.

The temperature in the last active stand of the finishing train is preferably above the γ-α phase transition, in particular above 820° C.

BRIEF DESCRIPTION OF THE DRAWING

An exemplary embodiment of the invention is illustrated in the drawing.

The only FIGURE schematically shows the lateral view of a single-strand cast-rolling installation for the production of a strip.

DETAILED DESCRIPTION OF THE INVENTION

The thin-slab cast-rolling concept proposed is composed of the following main components which are derived from the FIGURE:

The cast-rolling installation 2 for the production of the strip 1 first has a casting machine 3. A first furnace 4 in the conveying direction F of the material is disposed behind the casting machine 3; a roughing train 5 which has a number of roll stands R1 and R2 follows the first furnace 4 in the conveying direction F. A second furnace 6 follows behind the roughing train 5, a finishing train 7 having a plurality of roll stands F1, F2, F3, F4, F5, F6 in turn following said second furnace 6. A cooling section 8 which is followed by a reel 9 is disposed behind the finishing train 7.

A first shear S1 is disposed between the casting machine 3 and the first furnace 4. A second shear S2 is situated behind the roughing train 5 and ahead of the second furnace 6. A third shear S3 is finally situated just ahead of the reel 9.

At least one single slab fits into the first furnace 4 or/and into the first rolling table damping section; it is furthermore provided the least one single slab fits into the region between the first shear S1 and the first roll stand R1 of the roughing train 5. The roughing train 5 preferably consisting of 1 to 4 stands, wherein two stands are particularly preferably provided.

The second furnace 6 or/and the second rolling table damping section behind the roughing train 5 is/are configured such that at least one single rough strip in the horizontal position or extent, thereof, fits thereinto, or at least one single rough strip fits into the region between the second shear S2 and the first roll stand F1 of the finishing train 7. The finishing train 7 is in most instances composed of 1 to 7 stands; 4 to 6 stands are preferably provided.

The first shear S1 is a slab shear for separating the slabs which leave the casting machine 3. The second shear S2 is a rough strip shear for separating the rough strips behind the roughing train 5, and is preferably disposed ahead of the second furnace 6. The third shear S3 finally is a strip shear for separating the strips ahead of the reel 9.

Accordingly, the three shears S1, S2, and S3 are provided so as to be able to implement the above-mentioned dissimilar operating modes.

No rapid heating (in the form of induction heating, for example) is preferably provided in the cast-rolling installation 1, this being advantageous when using more cost-effective gas and under considerations in terms of energy.

Alternatively, rolling table damping sections into which at least one single slab or one single rough strip fits can be provided instead of the first furnace 4 or/and the second furnace 6 (for example, and preferably, in the form of a roller hearth furnace); in this case, inductive heating can optionally also be disposed behind said rolling table damping sections. An assembly of furnace parts and rolling table damping sections in an arbitrary sequence and combination is also possible ahead of and/or behind the roughing train.

The length of the first furnace (4), or the first rolling table damping section, or an assembly of first furnace parts (4) and rolling table damping sections in an arbitrary sequence and combination behind the first shear (S1), is preferably shorter than the length of the second furnace (6), or the second rolling table damping section, or an assembly of second furnace parts (6) and rolling table damping sections in an arbitrary sequence and combination behind the second shear (S2).

An individual slab or an individual rough strip is so long that one coil having a typically produced coil weight can be rolled or generated, respectively, from said individual slab or individual rough strip.

The cast-rolling installation (CSP installation) can be operated in a very flexible manner by way of an optimized operation of the main components mentioned. Various operating modes herein can be practically applied in the roughing train, in the finishing train, or in the overall installation.

According to the above-mentioned method mode a), continuous rolling in the roughing train 5 and continuous rolling in the finishing train 7 is initially possible, that is to say that the casting machine 3 as well as the roughing train and finishing train 5, 7 are connected to one another in this case. Rolling herein is performed by way of the casting machine mass flow, and the strips are separated by means of the third shear S3 at the reel 9.

According to the above-mentioned method mode b), continuous rolling in the roughing train 5 by way of the casting machine mass flow and single-strip rolling (batch operation) in the finishing train 7 is furthermore possible. The single rough strips herein are separated at the second shear S2. The mass flow in the finishing train 7 when rolling is higher than in the roughing train 5, or the connected casting machine 3, respectively. On account thereof, a combination of the advantages of continuous rolling in the relevant first stands, having relatively high forming ratios as well as an improved rough-strip geometry at the head and the tail, with the advantages of batch rolling in the finishing train 7 and the higher final rolling temperatures achievable therewith, results.

According to the above-mentioned method mode c), single strip rolling (batch operation) in the roughing train 5 and single strip rolling (batch operation) in the finishing train 7 is furthermore possible. The single slabs herein are separated at the first shear S1. The roughing train 5 and the finishing train 7 during the rolling procedure are both operated by way of a higher mass flow than the casting machine 3. The temperature management can be influenced in an arbitrary manner by individually choosing the speeds for the rolling trains.

According to the above-mentioned method mode d), a further operation is finally possible. When the first furnace 4 and the second furnace 6 are dimensioned such, or the spacings between the first shear S1 and the roll stand R1 of the roughing train 5, or/and between the second shear S2 and the roll stand F1 of the finishing train 7 are dimensioned, respectively, to be so long that said furnaces or spacings can receive more than one slab (for example, 2 or 3 slabs), semi-continuous strip rolling from the first furnace 4 or/and the second furnace 6, or the respective installation sections, respectively, is possible. A first separation of the semi-continuous slabs is performed at the first shear S1, or of the semi-continuous rough strips at the second shear S2, and a final separation to form individual strips is performed by way of the third shear S3 ahead of the reel 9.

The various operating modes can be chosen and set as a function of the final thickness or when starting-up the installation (at the beginning of casting) or prior to a roll change, or for temperature-related reasons. Warming-up the rolling installations in the roughing train and the finishing train can be performed, for example, in the batch mode. Firstly, a switch to the continuous mode can be carried out in the roughing train. In the case of increasingly thinner strips (preferably in the case of thicknesses of less than or equal to 1.2 mm), continuous strip rolling is expedient for the roughing train and the finishing train. When a roll change is planned only in the finishing train, switching to the batch mode takes place for the finishing train.

In order for the change over time for the work roll change in the finishing train to be gained, rolling is advantageously performed at an increased strip speed and/or temperature speed-up in the finishing train, or/and the casting speed as well as the rolling speed in the roughing train is reduced. In order for dissimilar slab temperatures or/and rough strip temperatures across the strip length to be equalized when batch rolling, and in order for ideally constant finished strip temperatures to be generated behind the finishing train, the roughing train or/and the finishing train are operated by way of a temperature speed-up or, alternatively, the water quantity of at least one intermediate stand cooling is correspondingly modified.

An increase in terms of flexibility is thus possible by way of the proposed installation.

The cast-rolling installation (CSP installation) proposed is distinguished by various advantageous technical installations and operating conditions.

An optimal arrangement of slab cleaning (or descaling, respectively) is present at the outlet of the casting machine 3 (less than 2 m) behind the last strand roll. Alternatively, the slab is cleaned (descaled) between the last two strand roll pairs.

Rolling table damping between the casting machine 3, or slab cleaning up to the entry of the first furnace 4, is advantageous. The damping is inwardly pivotable in the region of the first shear S1. The losses in terms of energy or temperature, respectively, are thus minimized in this transporting region.

The use of single-row descaling beams of a compact construction having a minimized specific descaling water quantity $v_{spec}$ based on the following condition is preferred:

$$V_{spec} \text{ in } m^3/h/m < 600 \times v, \text{ preferably } v_{spec} \text{ in } m^3/h/m < 450 \times v$$

where v is the transporting speed of the rolled or cast product in the region of the descaling washer in m/s ("x" being the multiplication sign).

The number of active finishing roll stands n is preferably adapted to the finished strip thickness $h_F$. To this end, the following approximation equation is used:

$$n \geq 5 \times h_F^{-0.6}$$

This means, in order for a correct finished strip final rolling temperature to be obtained in the case of comparatively thick final strip thicknesses, ramping up is performed by 1, 2, or 3 stands, commencing with the last finishing stands. In order for a good strip quality to be generated herein, strip cooling is preferably already commenced within the finishing train behind the last active stand. Pyrometers between the last finishing stands herein monitor the setting of the correct final rolling temperature and are used for closed-loop control purposes.

The respective first furnace 4 or/and second furnace 6, or corresponding rolling table regions having damping, can be subdivided into various regions (in the longitudinal direction) such that slabs or slab parts, respectively, or/and rough strips or rough strip parts, respectively, can be conveyed away. On account thereof, buffer times can be achieved, the cold strip be disposed of in a simple manner, or the elimination of malfunctions be simplified, for example. Moreover, flame cutting machines can be additionally provided ahead of or/and behind the furnace parts.

The mean slab temperature (definition: averaged across the thickness in the center) at the outlet of the first furnace 4 is ≥1000° C., preferably ≥1100° C.

The mean rough strip temperature at the exit from the second furnace 6 is ≥1100° C., preferably ≥1150° C.

By way of high-forming (overall finishing-train forming)

$$\varepsilon = (h_V - h_F)/h_V \times 100 \geq 96\%$$

($h_V$=rough strip thickness, $h_F$=finished strip thickness) in the finishing train, combined with a high rough strip temperature of ≥1150° C. (at the exit from the second furnace 6) and a high mass flow in m/min mm of $h_B \times v_B \geq 350$ m/min mm (preferably $h_B \times v_B \geq 500$ m/min mm), or generally with the condition, is a function of the number of stands $$2.316 \times h_B \times v_B \times e^{(-0.167 \times n)} \geq 480 \text{ m/min mm}$$

(where n=number of stands, $h_B$=slab thickness mm, $v_B$=slab speed m/min), inductive post-heating within the finishing train can typically be dispensed with in continuous rolling, and the installation can be advantageously operated so that the forming takes place in the last active finishing stand above the γ-α phase transition (for example, 820° C.). Inductive heating within the finishing train, between the finishing stands for the operating mode of continuous rolling or semi-continuous rolling, is optionally considered for establishing higher final rolling temperatures (for example ≥850° C.) or/and targeted influencing of the mechanical finished strip properties or/and at low casting speeds.

High-forming in the finishing train (see above for definition) having effective rolling-gap lubrication preferably at all stands (optionally excluding the last active finishing stand) is also advantageous, this achieving a rolling force reduction of >10% per stand as a result of the lubrication.

The transition from continuous rolling to batch rolling can be performed by way of a cut without any transition wedge at the first shear S1. The first shear S1 cuts, and finishing rolling of the continuous slab is performed, without any modification of the setup in the roll stands R1/R2 of the roughing train 5. A gap which permits that the roll stand R1 and/or the roll stand R2 in the case of the following slab engage thereon by way of a new setup is created by either reducing the casting speed and/or accelerating the rolling of the continuous slab.

LIST OF REFERENCE SIGNS

1 Strip
2 Cast-mailing installation
3 Casting machine

4 First furnace
5 Roughing train
6 Second furnace
7 Finishing train
8 Cooling section
9 Reel, or reeling installation
S1 First shear
S2 Second shear
S3 Third shear
R1, R2 Roll stand of the roughing train
F1, F2 Roll stand of the finishing train
F3, F4 Roll stand of the finishing train
F5, F6 Roll stand of the finishing train
F Conveying direction

The invention claimed is:

1. A method for producing a metallic strip in a cast-rolling installation, wherein the cast-rolling installation comprises:

a casting machine for casting a slab;

a first furnace and/or a first rolling table damping section, either or both following in a conveying direction of the metallic strip of the casting machine;

a first shear disposed between the casting machine and the first furnace and/or the first rolling table damping section;

a roughing train having a number of roll stands;

a second furnace and/or a second rolling table damping section, either or both following in the conveying direction of the metallic strip of the roughing train;

a second shear disposed between the roughing train and the second furnace and/or the second rolling table damping section;

a finishing train having a number of roll stands;

a cooling section;

a reeling installation having at least two reels or one reversing reel; and a third shear disposed between the cooling section and the reeling installation, the method including choosing one of the following operating modes for producing the strip:

a) continuous rolling, in which the casting machine, the roughing train, and the finishing train are operatively connected to one another, and the rolling of the material is performed by way of casting machine mass flow, wherein finished strips are separated at the reeling installation by the third shear;

b) continuous rolling in the roughing train, in which the casting machine and the roughing train are operatively connected to one another, and the rolling of the material is performed by way of the casting machine mass flow, and single-strip rolling in the finishing train, wherein rough strips rolled in the roughing train are separated by the second shear for the single-strip rolling in the finishing train;

c) single-strip rolling in the roughing train and single-strip rolling in the finishing train, wherein slabs made in the casting machine are separated by the first shear for the single-strip rolling in the roughing train and in the finishing train;

d) semi-continuous rolling in the roughing train and/or semi-continuous rolling in the finishing train, wherein the slabs made in the casting machine are separated by the first shear for the semi-continuous rolling in the roughing train and/or wherein the rough strips rolled in the roughing train are separated by the second shear for the semi-continuous rolling in the finishing train, wherein the finished strips are separated by the third sheer at the reeling installation wherein the rolling in the finishing train is carried out with a number of roll stands according to the correlation:

$$2.316 \times h_B \times v_B \times e^{(-0.167 \times n)} \geq 480 \text{ m/min mm}$$

where:

n: number of stands in the finishing train $h_B$: thickness of the slab in mm $v_B$: slab speed in m/min, wherein the first furnace, or the first rolling table damping section, or an assembly of first furnace parts and rolling table damping sections in an arbitrary sequence and combination behind the first shear has a length that is shorter than a length of the second furnace, or the second rolling table damping section, or an assembly of second furnace parts and rolling table damping sections in a sequence and combination behind the second shear.

2. The method according to claim 1, including placing at least one slab in the first furnace, or in the first rolling table damping section, or an assembly of first furnace parts and rolling table damping sections in a sequence and combination.

3. The method according to claim 1, including placing at least one slab or a rough strip in the second furnace, or in the second rolling table damping section, or an assembly of second furnace parts and rolling table damping sections in a sequence and combination.

4. The method according to claim 1, wherein a mean slab temperature at an outlet of the first furnace is at least 1000° C.

5. The method according to claim 4, wherein the mean slab temperature at the outlet of the first furnace is at least 1100° C.

6. The method according to claim 1, wherein a mean rough strip temperature at a outlet of the second furnace is at least 1100° C.

7. The method according to claim 6, wherein the mean rough strip temperature at the outlet of the second furnace is at least 1150° C.

8. The method according to claim 1, wherein a forming ratio of the strip in the finishing train is:

$$\varepsilon = (h_V - h_F)/h_V \times 100 \geq 96\%$$

$h_V$ being rough strip thickness, and $h_F$ being finished strip thickness.

9. The method according to claim 8, wherein a mean rough strip temperature at an outlet of the second furnace is at least 1150° C., wherein a product from a thickness of the strip and a speed of the strip is at least 350 mm m/min.

10. The method according to claim 9, wherein the product is at least 500 mm m/min.

11. The method according to claim 1, wherein no inductive heating of the slab and/or the rough strip is performed.

12. The method according to claim 1, wherein a temperature in a last active stand of the finishing train is above the γ-α phase transition.

13. The method according to claim 12, wherein the temperature in a last active stand is above 820° C.

14. The method according to claim 1, wherein inductive heating takes place within the finishing train, between the finishing stands, for the operating mode of continuous rolling or semi-continuous rolling, for establishing final rolling temperatures 850° C. and/or a targeted influencing of mechanical finished strip properties and/or at low casting speeds.

15. A cast-rolling installation for producing a rolled material, comprising:

a casting machine for casting a slab;

a first furnace and/or a first rolling table damping section, either or both following in a conveying direction of the metallic strip of the casting machine;

a roughing train having a number of roll stands;

a second furnace and/or a second rolling table damping section, either or both following in the conveying direction of the metallic strip of the roughing train;

a finishing train having a number of roll stands;

a cooling section;

a reeling installation having at least two reels or one reversing reel; and three shears for optionally separating slabs, rough strips, and/or finished strips, so as to implement dissimilar operating modes, the three shears including a first shear disposed between the casting machine and the first furnace and/or the first rolling table damping section;

a second shear disposed between the roughing train and the second furnace and/or the second rolling table damping section; and a third shear disposed between the cooling section and the reeling installation;

wherein the first furnace, or the first rolling table damping section, or an assembly of first furnace parts and rolling table damping sections in an arbitrary sequence and combination behind the first shear has a length that is shorter than a length of the second furnace, or the second rolling table damping section, or an assembly of second furnace parts and rolling table damping sections in an arbitrary sequence and combination behind the second shear, and so that at least one single slab fits into a region between the first shear and a first roll stand of the roughing train, and at least one single rough strip fits into a region between the second shear and a first roll stand of the finishing train, wherein a number of roll stands in the finishing train is given by the equation $$n \geq 5 \times h_F^{-0.6}$$

with a finished strip thickness $h_F$ in mm.

* * * * *